US005713716A

United States Patent [19]

Kubo

[11] Patent Number: 5,713,716

[45] Date of Patent: Feb. 3, 1998

[54] LIFTER FOR BOWLING LANE MAINTENANCE MACHINE AND METHOD OF USING THE SAME

[75] Inventor: Chikanari Kubo, Yamato, Japan

[73] Assignee: Eishin Technology Co., Limited, Ayase, Japan

[21] Appl. No.: 566,724

[22] Filed: Dec. 4, 1995

[30] Foreign Application Priority Data

Jun. 26, 1995 [JP] Japan ..... 7-180585

[51] Int. Cl.[6] ..... B66F 9/18

[52] U.S. Cl. ..... 414/618

[58] Field of Search ..... 414/618, 630, 414/631, 659, 662, 663, 661, 544, 541, 786, 622, 620, 621

[56] References Cited

U.S. PATENT DOCUMENTS

| | | | |
|---|---|---|---|
| 2,424,429 | 7/1947 | Bamberg | 414/544 |
| 2,730,257 | 1/1956 | Stresau, Jr. | 414/618 |
| 3,031,091 | 4/1962 | Erickson et al. | 414/544 |
| 4,024,959 | 5/1977 | Gruner | 414/618 X |
| 4,132,318 | 1/1979 | Wang et al. | 414/618 X |
| 4,365,921 | 12/1982 | Brouwer et al. | 414/631 X |
| 4,690,610 | 9/1987 | Fotheringham | 414/631 |
| 4,844,679 | 7/1989 | Teranishi | 414/618 X |

FOREIGN PATENT DOCUMENTS

| | | | |
|---|---|---|---|
| 265127 | 7/1968 | Austria | 414/631 |
| 820782 | 9/1959 | United Kingdom | 414/631 |
| 918474 | 2/1963 | United Kingdom | 414/630 |

*Primary Examiner*—David A. Bucci

*Attorney, Agent, or Firm*—Wood, Phillips, VanSanten, Clark & Mortimer

[57] ABSTRACT

A lifter includes a grasping device for grasping and holding a handle in the lane maintenance machine, vertically driving device for driving the grasping device in the vertical direction, horizontally driving device for driving the grasping device in the horizontal direction, and lifter moving device for moving the lifter. When the handle of the bowling lane maintenance machine is grasped by the grasping device and if the horizontally driving device, vertically driving device and lifter moving device are used step-by-step in a combination, the bowling lane maintenance machine can be safely and easily shifted from one position to the other position or vice versa.

7 Claims, 11 Drawing Sheets

FIG. 3
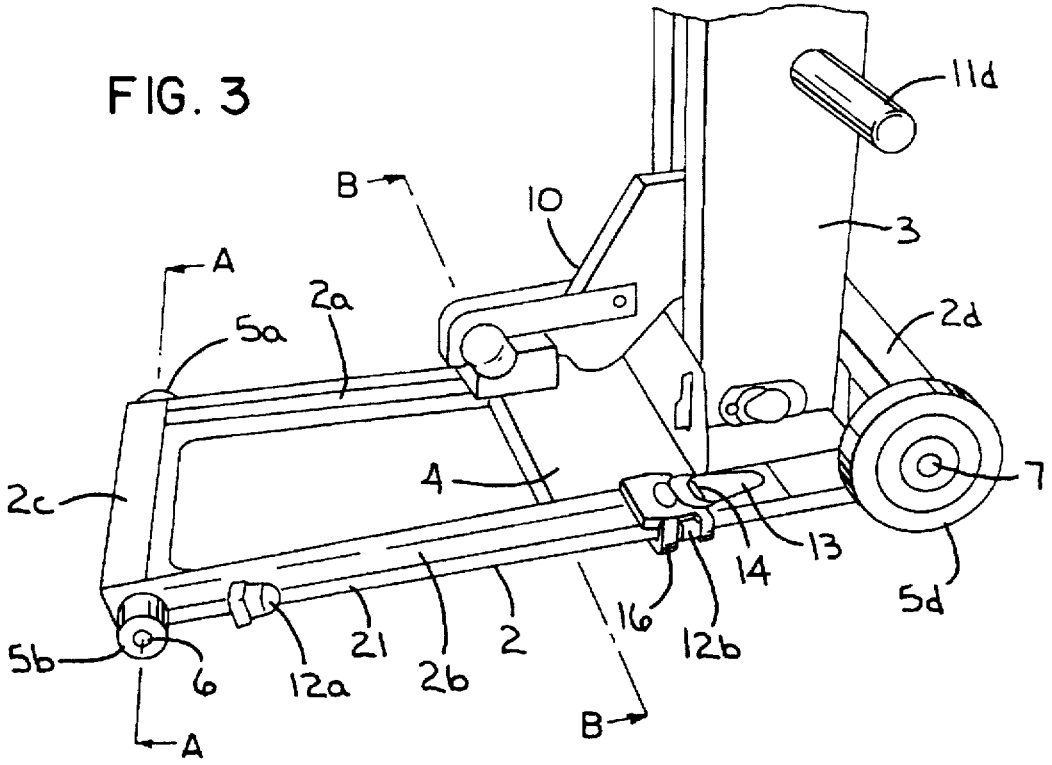
FIG. 4
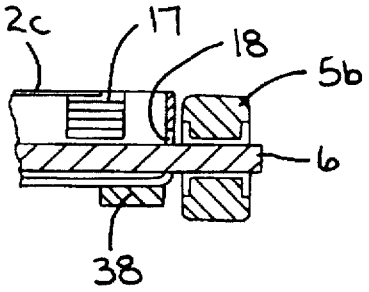
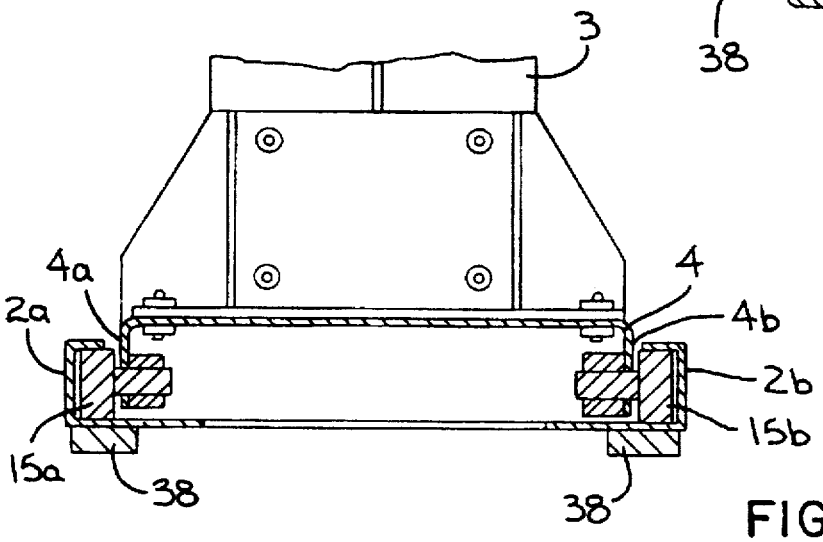
FIG. 5

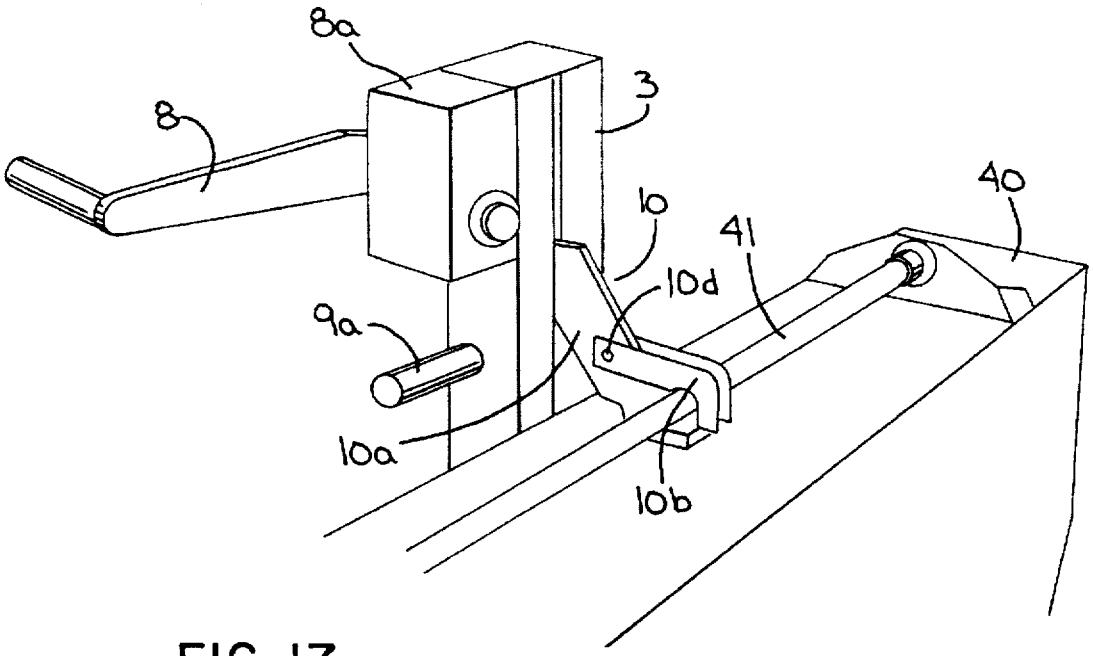
FIG. 17
FIG. 18
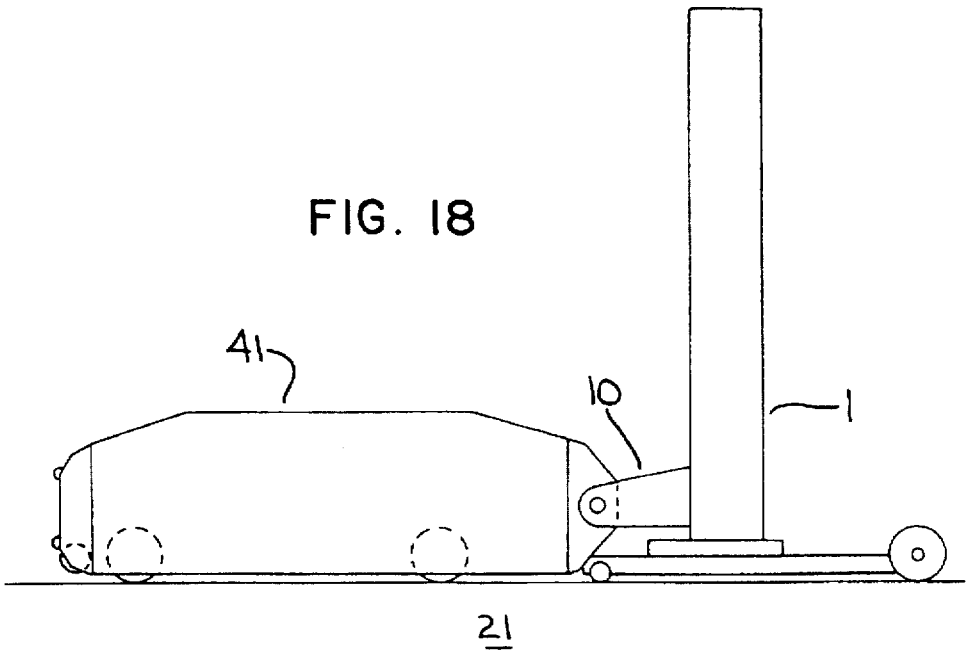

LIFTER FOR BOWLING LANE MAINTENANCE MACHINE AND METHOD OF USING THE SAME

BACKGROUND OF THE INVENTION

1. Field of the Invention

The present invention relates to an improved lifter for a machine for maintaining the surfaces of lanes in a bowling alley (which machine will be simply called "lane maintenance machine"). More particularly, the present invention relates to a new apparatus which can shift the lane maintenance machine from a position wherein the lane maintenance machine can run on a bowling lane to another position wherein the lane maintenance machine can be carried and moved or vice versa.

2. Description of the Prior Art

In the prior art, the lane maintenance machine was manually shifted from a position wherein the lane maintenance machine can run on a bowling lane to another position wherein the lane maintenance machine can be carried and moved or vice versa. Namely, an operator shifted the lane maintenance machine having its weight ranging between about 150 Kg and about 200 Kg by grasping and manipulating a handle 41 in the lane maintenance machine (see FIG. 15) with all his or her might. This often damaged the back of the operator. It has thus been desired to provide an apparatus or machine which can perform such a severe operation in place of the operator.

SUMMARY OF THE INVENTION

It is therefore an object of the present invention to provide an apparatus and method which can easily shift the lane maintenance machine from a position wherein the lane maintenance machine can run on a bowling lane (which position will be called "running position" hereinafter) to another position wherein the lane maintenance machine can be carried and moved (which position will be called "moved and transported position" hereinafter) or vice versa.

To this end, the present invention provides a lifter for shifting the bowling lane maintenance machine from a position wherein the lane maintenance machine can run on a bowling lane to another position wherein the lane maintenance machine can be carried and moved or vice versa, the lifter comprising at least four means: means for grasping and holding a handle in the lane maintenance machine; vertical driving means for moving the grasping means in the vertical direction; means for moving the grasping means in the horizontal direction; and means for moving the lifter over the floor or other surface upon which it rests.

The grasping means may comprise upper and lower arms. The upper and lower arms is pivotally connected to each other at their bases. The handle of the lane maintenance machine is caught and held between the upper and lower arms. It is desirable that the upper and lower arms are of strong structure and include a latching mechanism for preventing the held handle from being easily removed.

The vertical driving means may comprise a structure having a vertical support and a vertical driving mechanism for moving the grasping means along the vertical support. Such a vertical driving mechanism may be mounted within the support in any one of various forms such as a combination of sprocket and chain, a combination of rotor and belt, a combination of rotor and wire cable, a combination of rack and pinion, a cylinder and others.

It is further required to provide external means for operating the vertical drive. With a sprocket-chain mechanism within the support, a handle connected to a gearing may be provided outside the support. As such a handle is manually rotated, the gear drive sprocket chain moves the grasping means connected to the chain in the vertical direction. If the gearing is formed by a combination of gears, a force required to rotate the handle can be reduced.

The vertically driving mechanism may be in the form of an air cylinder or electric motor.

The horizontally driving means may be of a structure movable with the support in the horizontal direction if the vertically driving means is of a structure comprising a support and a mechanism movable along the support in the vertical direction. More particularly, the bottom of the support may include a slider having a plurality of ground wheels. These ground wheels may be rotated within the respective grooved cavities which are formed in the base of the lifter.

Alternatively, the horizontally driving means may be of a structure which includes any one of various bearing means such as linearly moving bearings.

The present invention also provides a method of using such a lifter, which may comprise a step of actuating the horizontally driving means while maintaining the lane maintenance machine at a position in which the lane maintenance machine has been moved to its midway position between the uppermost and lowermost positions. This requires a mechanism for temporarily locking the horizontally driving means. Such a mechanism may be of a combination of a temporal catch in the base of the lifter with a hooked projection on the slider.

The lifter moving means may comprise two pairs of front and back wheels on the base bottom of the lifter. Thus, the lifter moving means can easily transport the lifter to a position in which the lane maintenance machine resides.

Since the lifter must lift the heavy lane maintenance machine, it is required that the lifter is of a structure bearable such a heavy load. It is further required that the weight of the lifter itself is minimized for easy transportation. To meet such requirements, most of the lifter may be formed by a thin folded steel sheet while only the part subjected to the heavy load may be formed by a thick steel sheet. When the transportable lifter has the ground wheels contacting the ground or floor, these ground wheels will be subjected the highest load. To avoid such a problem, a resilient member may be located between each ground wheel and the lifter while an ellipse slot may be formed to receive the shaft of each wheel. Thus, the ground wheels will not directly receive the heavy load.

To facilitate the maintenance and repair of the lifter and to produce the lifter more cheaply, it is desirable that the lifter is of a structure formed as simply as possible and by an inexpensive material. For such a purpose, most of the lifter may be formed of an easily available and cheaper steel sheet. The lifter may be produced in a manner as simple as possible.

When the lane maintenance machine is to be shifted from a position wherein the lane maintenance machine can run on a bowling lane to another position wherein the lane maintenance machine can be carried and moved, the grasping means of the lifter is moved to its lowermost position by the vertically driving means and to its forwardmost position by the horizontally driving means. Under such a condition, the lifter moving means is actuated to move the lifter to a position near the lane maintenance machine. The grasping means is then actuated to grasp the handle in the lane maintenance machine. The vertically driving means is actuated to move the grasping means in the upward direction. When the grasping means reaches a position spaced away from the floor by a distance between 10 cm and 15 cm, the upward movement of the grasping means is stopped. The horizontal driving means is then actuated to pull the grasping means all the way to the back on the lifter and temporarily lock it there. Thereafter, the vertical driving means is actuated to lift the grasping means to a position in which the lane maintenance machine is completely stood up and is resting on its own wheels and can be transported to another lane or stored position. At such a time, the grasping means can be disengaged from the handle of the lane maintenance machine and the lifter disengaged from the maintenance machine.

When the lane maintenance machine is to be shifted from the stored position to the position wherein the lane maintenance machine can run on a bowling lane, the aforementioned procedure may be reversed.

BRIEF DESCRIPTION OF THE DRAWINGS

FIG. 3 is a fragmentary perspective view, in an enlarged scale, of the lifter shown in FIG. 1.

FIG. 4 is a fragmentary cross-sectional view of the lifter as taken along a line A—A in FIG. 3.

FIG. 5 is a cross-sectional view of the lifter as taken along a line B—B in FIG. 3.

FIG. 17 is a perspective view of the lane maintenance machine with the lifter of the present invention.

FIGS. 18–23 are views illustrating a procedure by which the lifter of the present invention is used to shift the position of the lane maintenance machine.

DETAILED DESCRIPTION OF THE PREFERRED EMBODIMENTS

Figure 1:
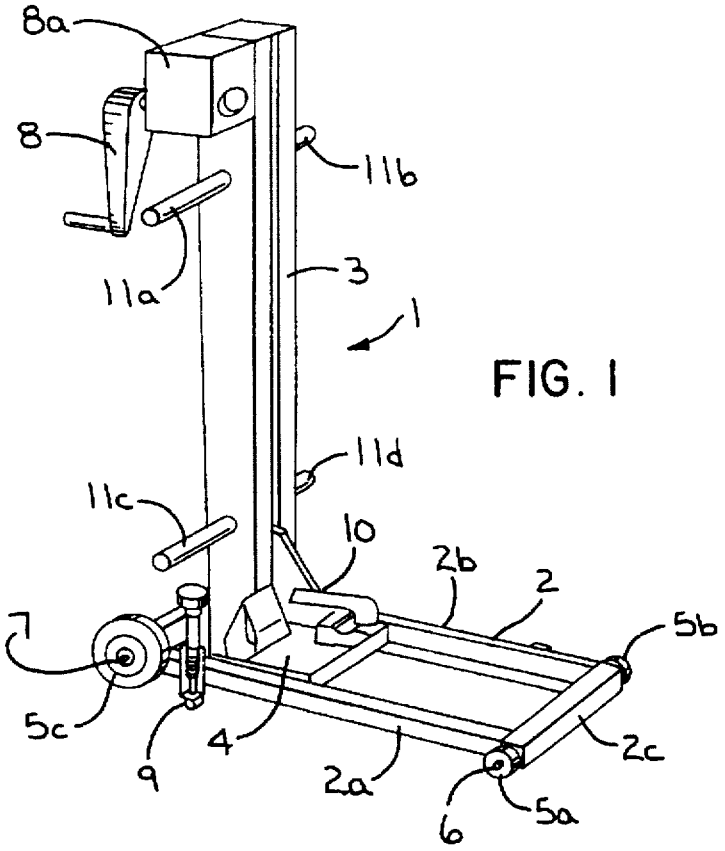
FIG. 1 is a perspective view of a lifter according to the present invention as viewed from the forward and upward direction.
Figure 2:
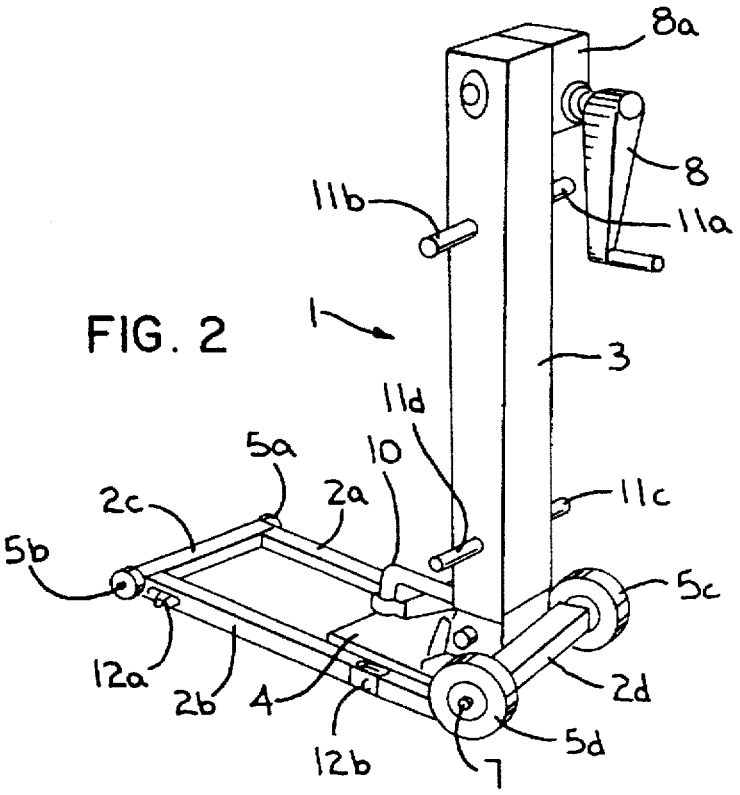
FIG. 2 is a perspective view of the lifter as viewed from the backward and upward direction.

Referring now to FIGS. 1 and 2, a lifter 1 comprises a base 2, a slider 4 in the form of a wheeled carriage translatable relative to the base 2 in the horizontal direction, and a vertical support 3 fixedly mounted on the slider 4.

The base 2 comprises a main body formed of a steel sheet having a thickness between 1.6 mm and 3.2 mm, the main body including left- and right-side bent portions **2*a*, 2*b* of substantially C-shaped cross-section and a bottom having a rectangular opening formed therethrough with round corners, and two rod-like transverse members 2*c* and 2*d* of substantially C-shaped cross-section which are formed of similar material and screwed to the main body at its forward and backward ends (also see FIGS. 3 and 5). The base 2 also comprises front wheels 5*a*, 5*b* and back wheels 5*c*, 5*d* which are used to move the lifter 1 on the floor. The base 2 further comprises at least one base stopper 9 which is temporarily used to fix the lifter 1** on the floor.

Referring now to FIG. 3, the base 2 includes front and back stoppers **12*a* and 12*b* fixedly mounted on the left side 2*a*. When the front base stopper 12*a* is impacted by a T-shaped stopper 16 on the slider 4 which will be described later, the forward translation of the slider 4 is stopped. When the back base stopper 12*b* is impacted by the T-shaped stopper 16, the backward translation of the slider 4 is stopped. The base 2 further comprises a temporal catch 13 fixedly mounted thereon adjacent the back wheel stopper 12*b*. When the temporal catch 13 is engaged by a hooked projection 14 which will be described later, the temporal catch 13 can temporarily hold the slider 4 against the back stopper 12*b* (also see FIGS. 5 and 7**).

The slider 4 is formed by folding a steel sheet having a thickness between 1.6 mm and 3.2 mm (see FIG. 5). The slider 4 comprises a T-shaped stopper 16 and a hooked projection 14 fixedly mounted on the slider adjacent the T-shaped stopper 16 (also see FIGS. 6 and 7).

Each of the opposite sides **4*a* and 4*b* in the slider carriage include two slider wheels (15*a* and 15*c*; 15*b* and 15*d*, respectively), which are located spaced away from each other along that side of the slider carriage 4. The slider carriage 4 can be translated relative to the floor when the wheels 14*a*, 15*b*, 15*c* and 15*d* rotatably move within the left- and right-side C-shaped portions 2*a* and 2*b* of the main base body 2 (also see FIGS. 5, 6 and 7**).

Figure 9:
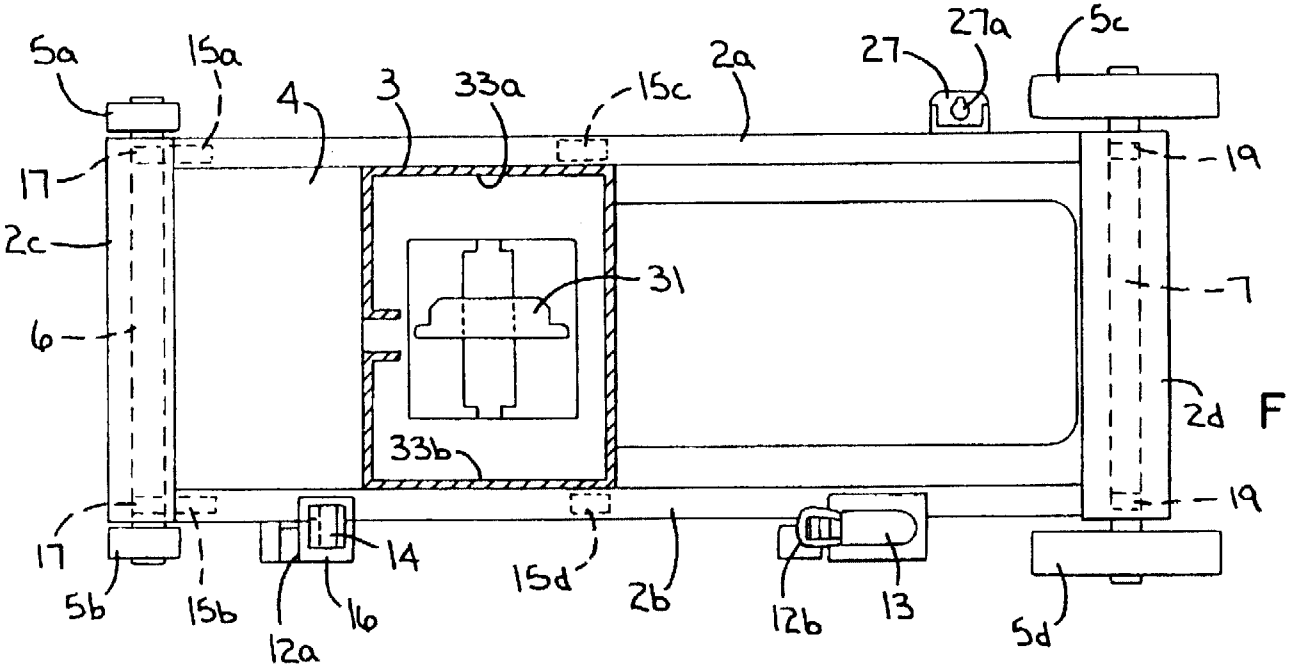
FIG. 9 is a top view of the lifter as partially broken away along a line C—C in FIG. 6.
Figure 13:
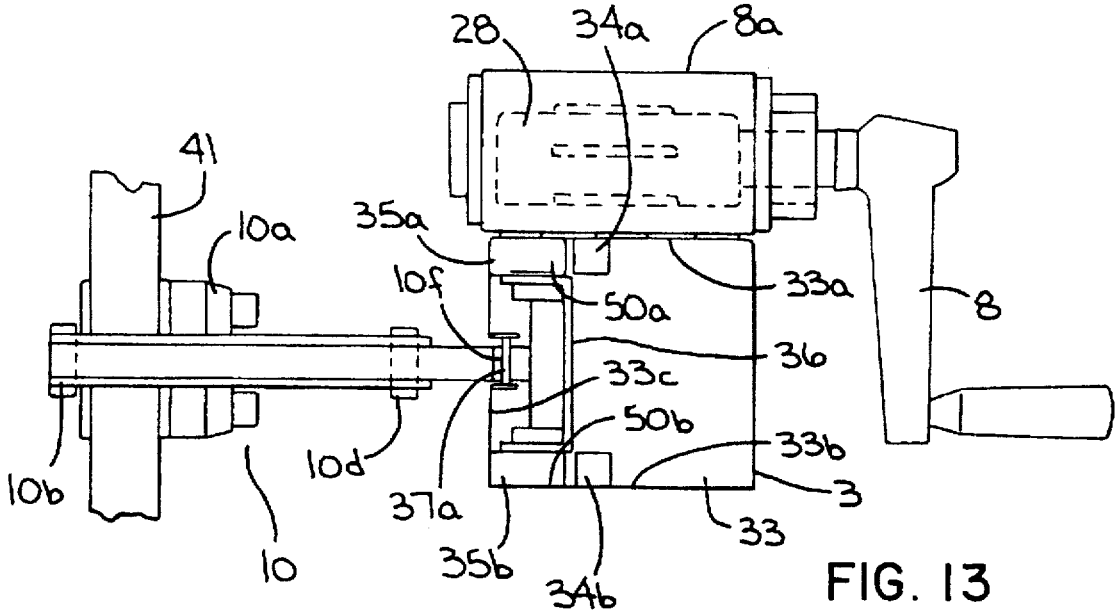
FIG. 13 is a cross-sectional view of the lifter as taken along a line D—D in FIG. 12.

The vertical support 3 is formed by folding a steel sheet having a thickness between 1.6 mm and 2.3 mm (see FIGS. 9 and 13). Referring again to FIGS. 1 and 2, the top side of the support 3 includes a box-like handle base **8*a* from which a handle 8 extends backwardly. A handle grip 10 configured to grip the handle of the lane maintenance machine extends forwardly from the front side of the support 3. When the handle 8 is manually rotated, the handle grip 10 can be moved vertically along the support 3. The support 3 further includes hand grips 11*a*, 11*b*, 11*c* and 11*d* which are fixedly mounted on the opposite sides thereof. These grips are used to stabilize the lifter with operator's hands and feet when the lifter 1 is to be moved on the floor or when the handle 8** is to be rotated.

Referring now to FIGS. 4, 6, 7 and 8, compression springs 17 are located between the front axle 6 of the wheels **5*a* and 5*b* and the base 2. The base 2 includes elliptical axle holes 18 formed therethrough for the front axle 6 of the front wheels 5*b* and 5*a*. Tension springs 19 are located between the back axle 7 and the base 2. The base 2 also includes elliptical axle holes 20 for the axle 7 for the back wheels 5*d* and 5*c*. With provision of the springs 17 and 19, the load on the front and back wheels 5*a*–5*d* can be relieved when the lane maintenance machine is received by the lifter 1**.

The axle holes 18, 20 and front and back wheels **5*a*–5*d* are so sized and positioned that when the load exceeds about 10 Kg, the base 2 is just seated against the floor 21. More particularly, a center-to-center distance d between two circles defining the ellipse axle hole 18 (see FIG. 8) is equal to or slightly larger than a distance between the bottom of a protective member 38 (FIG. 4) described later and the floor. When the member 38 on base 2 is seated against the floor 21, no load will be on the front and back wheels 5a–5d**.

Figure 6:
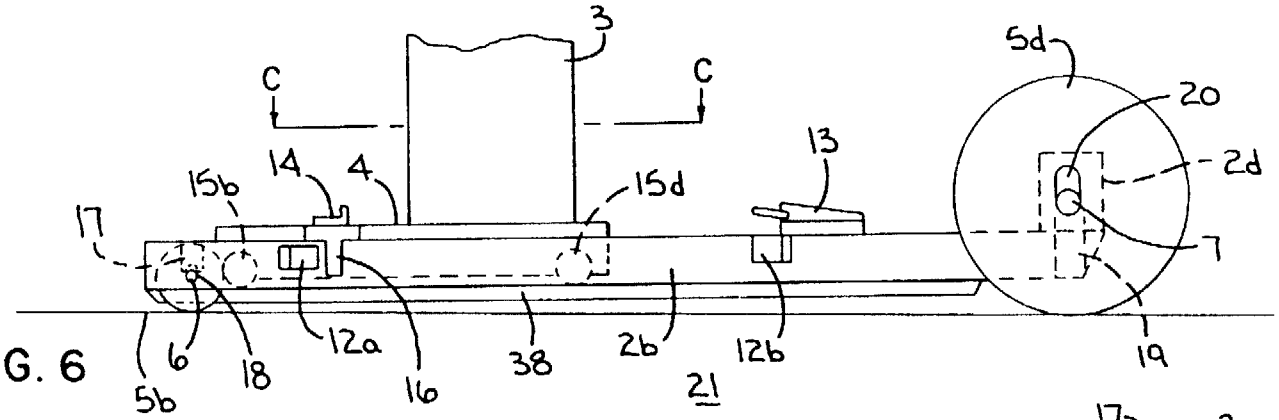
FIG. 6 is a schematic side view of the lifter as viewed in an operational position.
Figure 8:
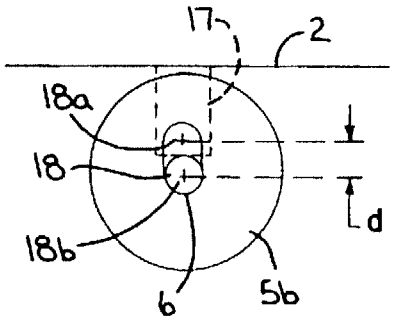
FIG. 8 is a view showing a part of the lifter.
Figure 7:
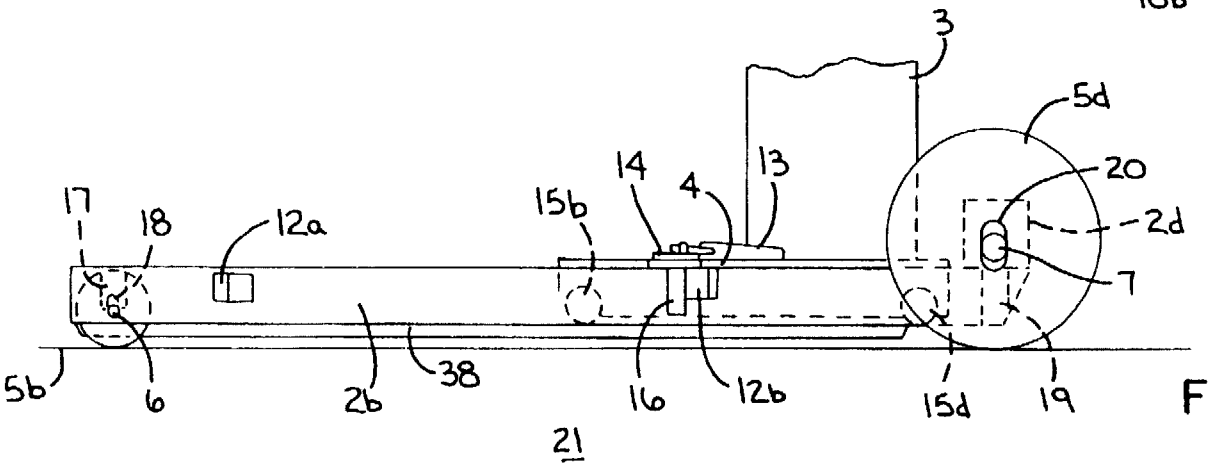
FIG. 7 is a schematic side view of the lifter as viewed in another operational position.

Referring further to FIGS. 5, 6 and 7, a protective member 38 of plastic material is formed on the bottom of the base 2. The protective member 38 can prevent the floor 21 from be damaged by the base 2 when the latter is seated on the floor 21.

Figure 10:
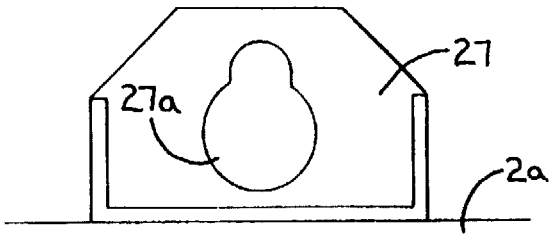
FIG. 10 is a view showing another part of the lifter.
Figure 11:
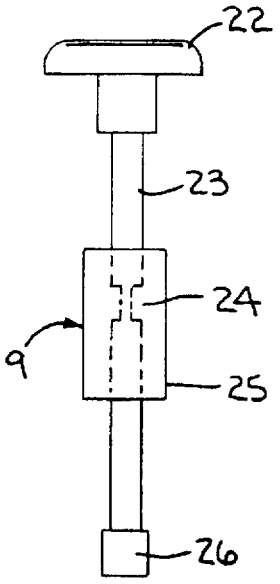
FIG. 11 is a view showing still another part of the lifter.

Referring to FIG. 11, the base stopper 9 comprises a stopper grip 22, a stopper stem 23, a stopper compression spring 25 and a non-slip 26. The stopper stem 23 includes a stopper stem notch 24 formed therein. As shown in FIGS. 9 and 10, the base 2 includes a stopper locking member 27 fixedly mounted thereon. The stopper locking member 27 includes a guitar-shaped opening 27a formed therethrough. The opening 27a consists of a larger aperture having a diameter larger than that of the stopper stem 23 and a smaller aperture having a diameter smaller than that of the stopper stem 23 but larger than that of the stopper stem notch 24. Under the normal condition, the non-slip 26 is seated against the floor by the biasing force of a compression spring 25. When the stopper grip 22 is upwardly moved to engage the stopper stem notch 24 into the smaller aperture of the guitar-shaped opening 27a in the stopper locking member 27, however, the non-slip 26 can be lifted separated from the floor. Thus, the lifter 1 can be moved. When it is wanted to fix the lifter temporarily on the floor, such a procedure may be reversed to disengage the stopper stem notch 24 from the smaller aperture of the guitar-shaped opening 27a.

Figure 12:
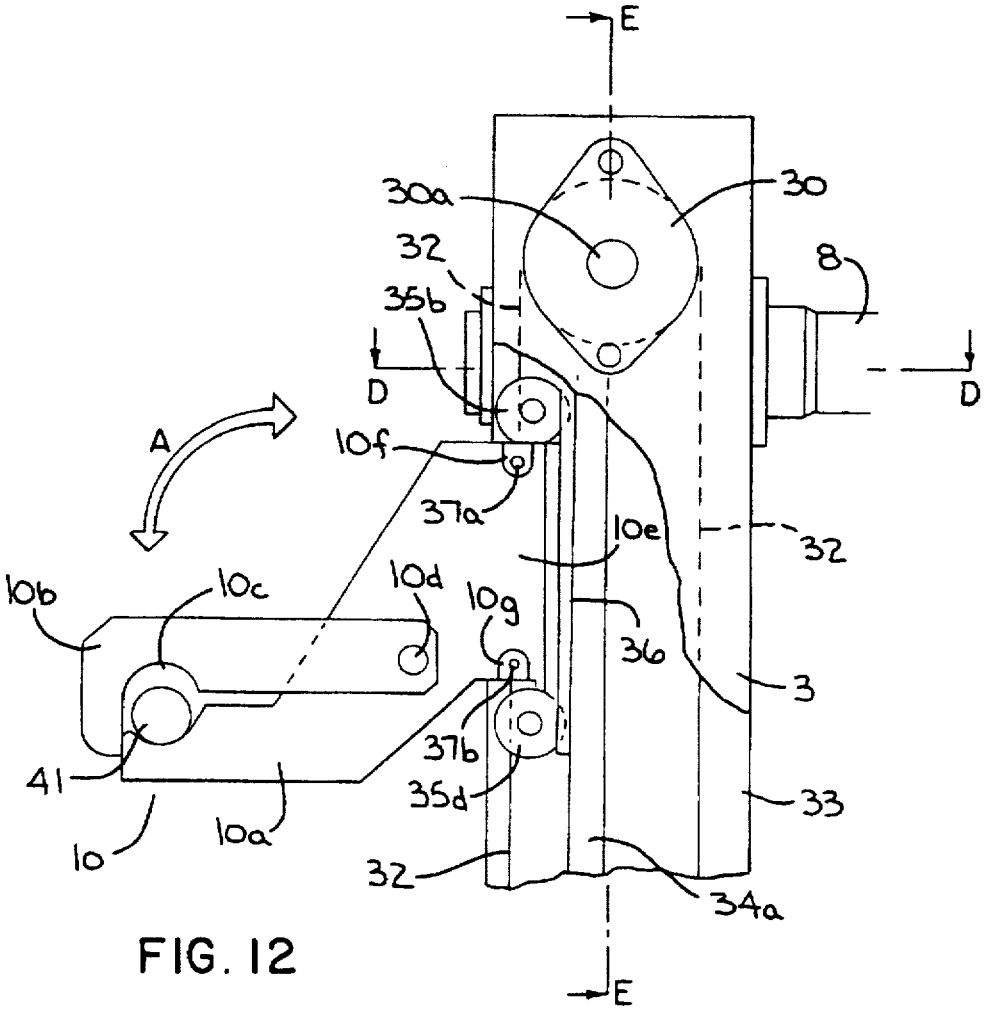
FIG. 12 is a side view, partially broken away, of the top of the support in the lifter according to the present invention.

Referring now to FIG. 12, the hand grip 10 comprises a lower grip arm 10a and an upper grip arm 10b. The lower and upper grip arms 10a, 10b are pivotally connected to each other through a pivot 10d. The lower grip arm 10a is formed of a steel sheet having a thickness between 8 mm and 12 mm. The upper grip arm 10b is formed by two steel sheets of the same configuration having a thickness between 3.2 mm and 4.5 mm, which is screwed to each other with the lower grip arm 10a being sandwiched therebetween (also see FIGS. 3 and 17). In such an arrangement, the hand grip 10 can bear the heavy weight of the lane maintenance machine.

Referring further to FIG. 12, the upper grip arm 10b can be rotated about the pivot 10d through 90 degrees in a direction shown by arrow A. When the upper grip arm 10b is engaged by the lower grip arm 10a, a grip space 10c will be produced therebetween. The grip space 10c can receive the handle 41 of the lane maintenance machine.

The lower grip arm 10a has a base 10e including top and bottom recesses 10f and 10g of U-shaped cross-section. Each of the top and bottom recesses 10f and 10g fixedly receives a chain anchoring pin 38a or 37b which is connected to a chain 32 at the corresponding end thereof. Thus, the chain 32 can form a complete loop as described below.

Referring now to FIGS. 12 and 13, the base 10e of the lower grip arm 10a is screwed to a carriage guide member 36 which moves within the cavity 33 of the support 3. The carriage guide member 36 is formed by folding a steel sheet having a thickness between 1.6 mm and 2.3 mm into a substantially C-shaped cross-section. The carriage guide member 36 has a vertical height larger than that of the lower arm base 10e. The carriage guide member 36 includes four guide wheels, that is, a pair of upper guide wheels 35a, 35b and a pair of lower guide wheels 35c, 35d. Each of the inner left- and right-side walls, 33b and 33a, respectively, of the support cavity 33 have a guide pillar 34b and 34a, respectively, fixedly mounted thereon. The guide pillars 34a and 34b extend substantially along the length of the support 3 and together with the side walls 33a and 33b and the front inside wall 33c of the cavity 33, form a pair of U-shaped channels 50a and 50b running vertically along the inside walls 33a and 33b of the cavity 33. The carriage guide wheels 35a and 35c roll within the channel 50a while the guide wheels 35b and 35d roll within the channel 50b. Thus, the carriage guide member 36 with handle grip 10 secured thereto can be moved along the support 3 in the vertical direction.

Figure 14:
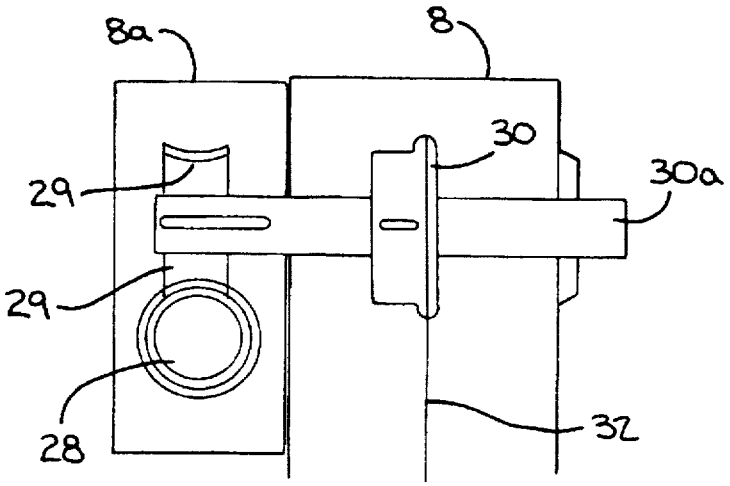
FIG. 14 is a fragmentary cross-sectional view of the lifter taken along a line E—E in FIG. 12.

An upper sprocket 30 is supported by an upper sprocket shaft 30a and is located in the cavity 33 at a position adjacent the top of the support 3 (FIG. 14). The lower sprocket 31 is supported by a lower sprocket shaft 31a and is located in the cavity 33 at a position adjacent the bottom of the support 3 (FIG. 9). The chain connected to one of the anchoring pins 37a extends upwardly to the upper sprocket 30 within the support cavity 33 and around the upper sprocket 30 downwardly toward the lower sprocket 31. The chain further extends upwardly from around the lower sprocket 31 and is then connected to the other anchoring pin 37b.

As shown in FIG. 13, the handle 8 includes a worm gear 28 located within the handle base 8a. As shown in FIG. 14, the worm gear 28 of the handle 8 is operatively engaged by another worm wheel gear 29 which is fixedly connected to the upper sprocket 30 through an upper sprocket shaft 30a. In such an arrangement, as the handle 8 is manually rotated, the handle worm gear 28 is also rotated in the same direction. The rotation of the worm gear 28 causes the worm wheel gear 29 to rotate in the opposite direction with a reduced speed. This causes an increased force which in turn rotates the upper sprocket 30 in the same direction as that of the worm wheel gear 29. The rotation of the upper sprocket 30 causes the chain 32 to move such that the hand grip 10 will be moved upwardly or downwardly.

Figure 15:
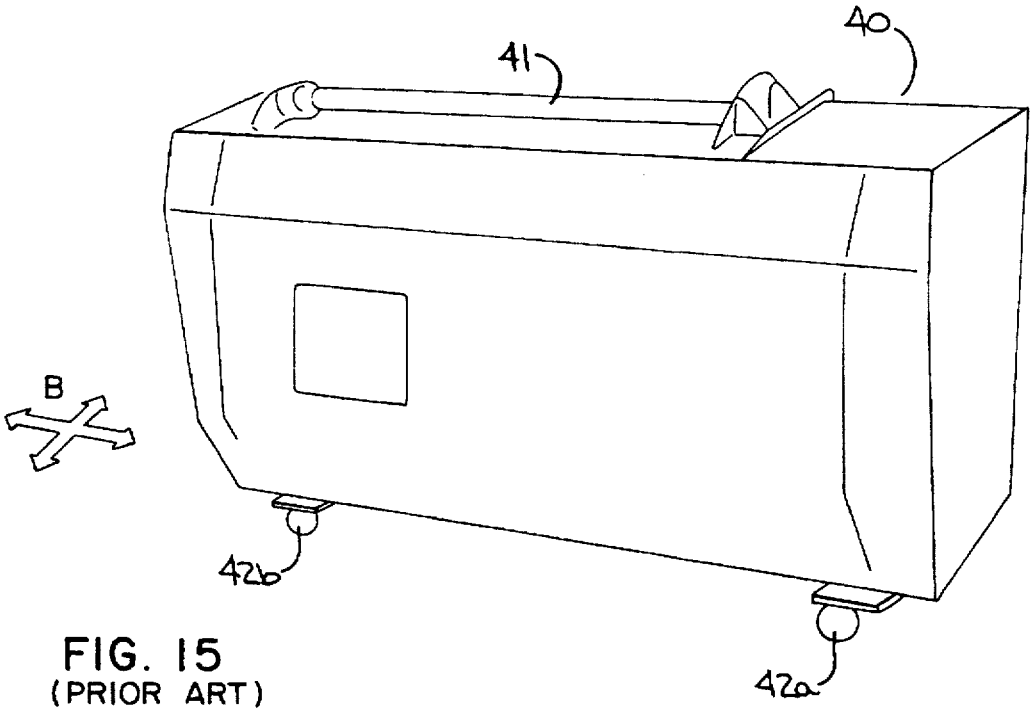
FIG. 15 (PRIOR ART)
FIG. 15 is a perspective view of a lane maintenance machine.
Figure 16:
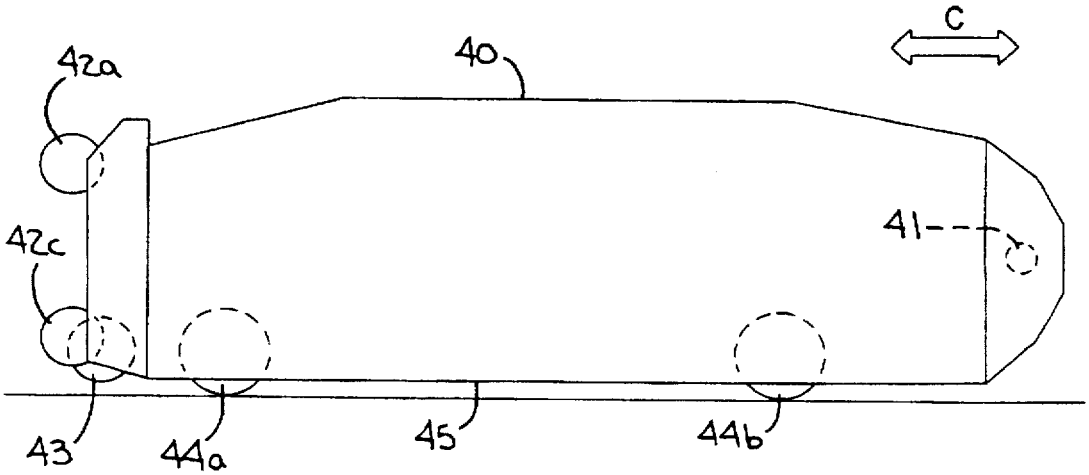
FIG. 16 (PRIOR ART)
FIG. 16 is a side view of the lane maintenance machine.
Figure 19:
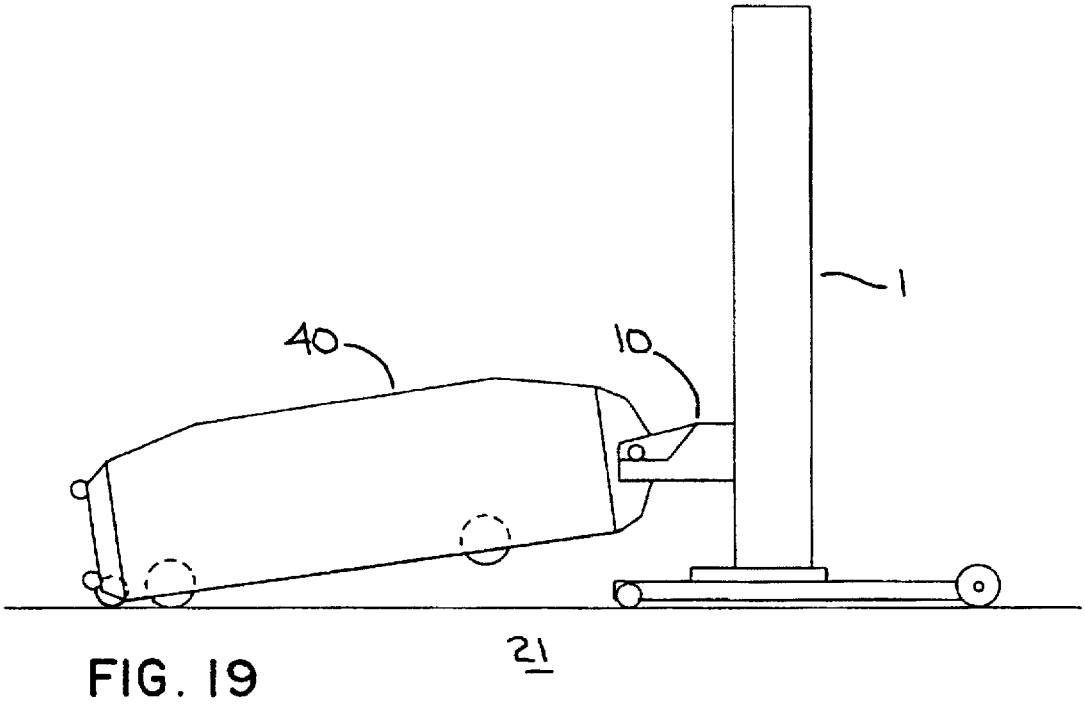
Figure 20:
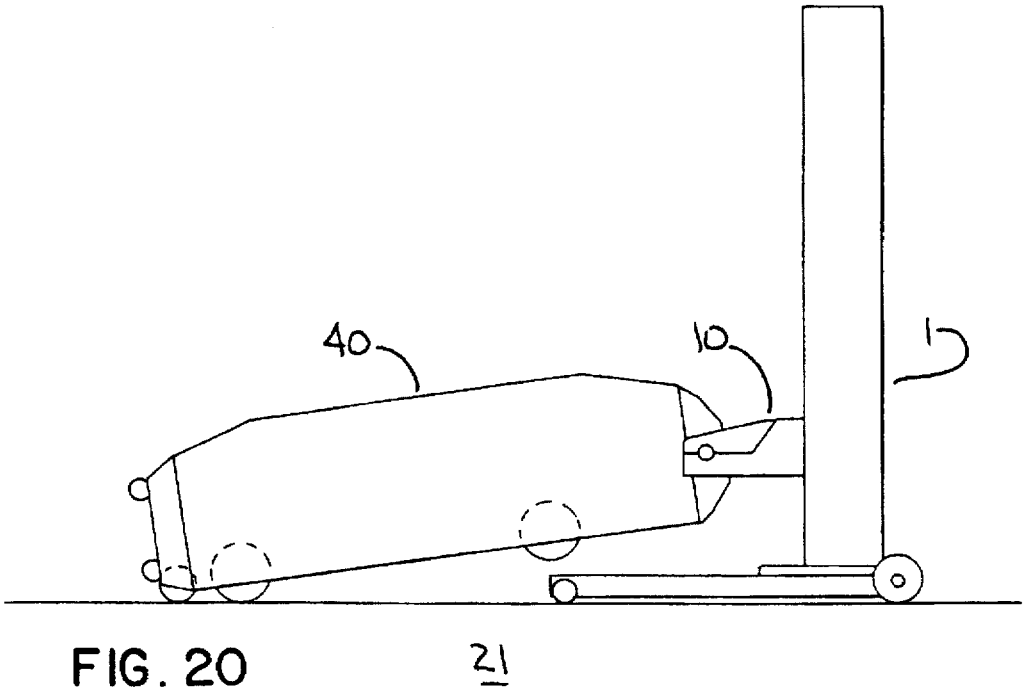
Figure 21:
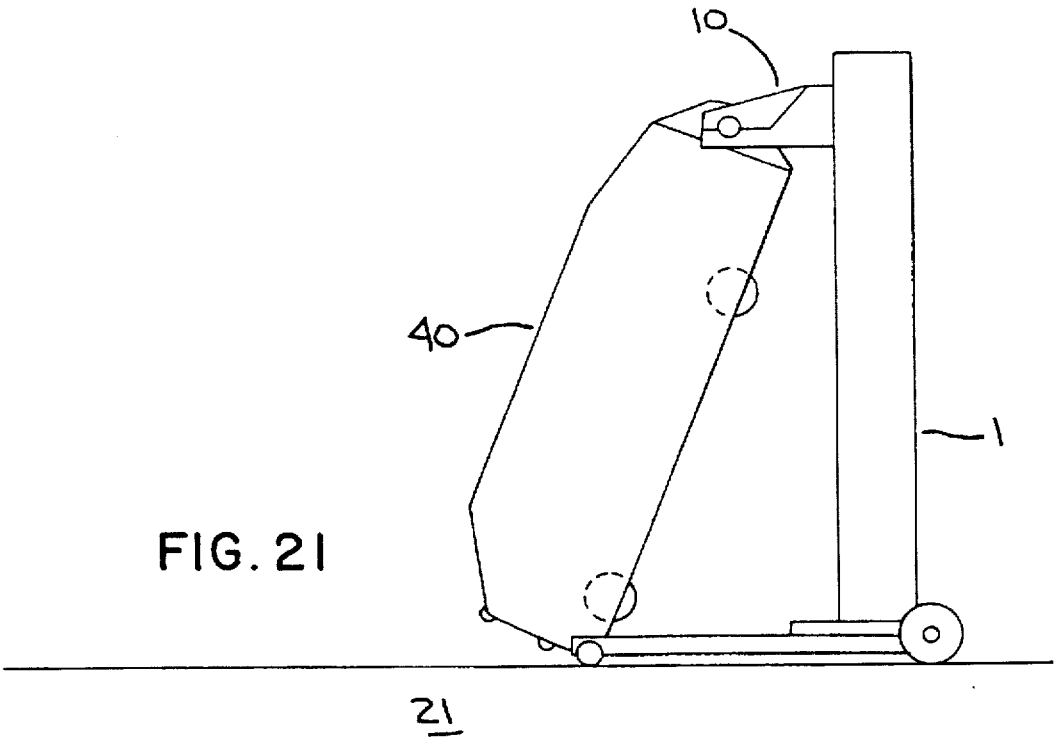
Figure 22:
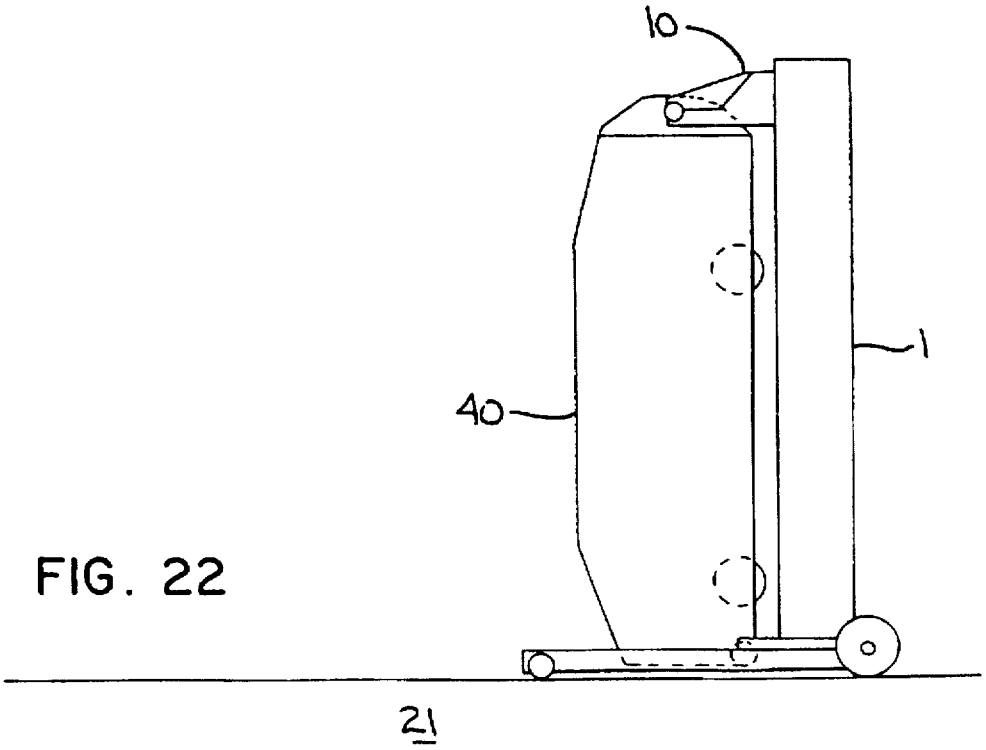

FIGS. 15 and 16 show one of the conventional lane maintenance machines 40 with which the lifter of the present invention is used. The top of the lane maintenance machine 40 includes such a handle 41 as previously described, which handle 41 had been manually grasped to stand the lane maintenance machine 40 upright (FIG. 15) or lay the same down upon its bottom 45 (FIG. 16), according to the prior art. The bottom 45 of the lane maintenance machine 40 has four steerable casters attached thereto, one near each of its four corners, of which only the near side two (42a and 42b) are shown in FIG. 15. If the lane maintenance machine 40 was standing upright as shown in FIG. 15 and the handle 41 of the lane maintenance machine 40 was manually grasped and pushed, the lane maintenance machine 40 could be moved in any direction, as indicated by arrow B.

The working face 45 or bottom of the lane maintenance machine 40 may also include four ground wheels, one located near each of its four corners, only two of which (44a and 44b) are shown in FIG. 11. These wheels permit the lane maintenance machine 40 to be moved in a direction shown by arrow C when positioned lying down as shown in FIG. 16.

The lane maintenance machine 40 further includes a pair of pulling-out wheels 43 which are used only when the lane maintenance machine 40 is to be shifted from its running position to its moved and transported position. The pulling-out wheels 43 are adapted to engage the floor only when the position of the lane maintenance machine 40 is being shifted with both the ground wheels and casters being not engaged by the floor. With provision of the pulling-out wheels 43, the lane maintenance machine can be smoothly shifted in position without damage to both the floor and lane maintenance machine.

Referring now to FIGS. 18 to 23, there will be described the lifter 1 when the lane maintenance machine is shifted from its running position to its moved and transported position. First, the slider 4 is moved to its forwardmost position and the handle 8 is manually rotated to move the hand grip 10 to its lowermost position. Under such a condition, the operator moves the lifter 1 to a position adjacent the lane maintenance machine 40. The upper grip arm 10*b* is then stood up to bring the hand grip 10 into its graspable position. The upper grip arm 10*b* is thereafter returned to its original or lower position to sandwich the handle 41 of the lane maintenance machine 40 between the upper and lower grip arms 10*b* and 10*a* (see FIG. 18).

Second, the lifter handle 8 is manually rotated to move the hand grip 10 upwardly. As the hand grip 10 has been raised to such a height that the base 2 of the lifter 1 can be inserted between the working face 45 of the lane maintenance machine 40 (see FIG. 16) and the floor surface 21, the manual rotation of the lifter handle 8 is stopped. Such a height depends on the magnitude of the lane maintenance machine used, but may normally range between 10 cm and 15 cm (see FIG. 19).

Third, the grips 11*a*, 11*b*, 11*c* and/or lid of the support 3 are grasped to move the support and slider 3, 4 to the backwardmost position. The temporal catch 13 is caused to engage the hooked projection 14 for temporal connection between the slider 4 and the base 2.

Fourth, the lifter handle 8 is again rotated to move the hand grip 10 further in the upward direction. The hand grip 10 is then rotated until the lane maintenance machine 40 has been completely stood up, using the pulling-out wheels 49 (see FIGS. 21 and 22). After the lane maintenance machine 40 has been completely stood up into its moved and transported position, the upper grip arm 10*b* is raised to disengage the hand grip 10 from the handle 41. As a result, the lane maintenance machine 40 will be separated from the lifter 1.

Figure 23:
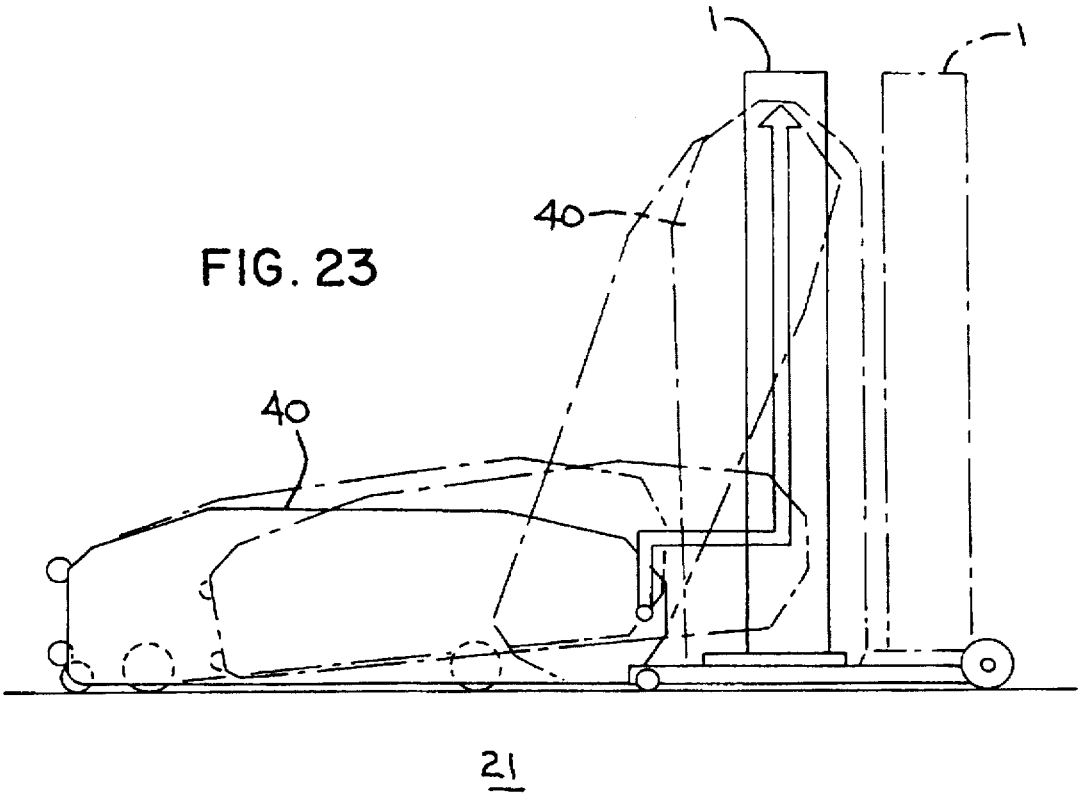

The locus of the lifter handle 8 through the first to fourth steps is as shown by arrow in FIG. 23.

The procedure through which the lane maintenance machine is shifted from its moved and transported position to its running position will be described.

First, the support and slider 3, 4 are moved to their backwardmost position wherein the temporal catch 13 is caused to engage the hooked projection 14 for temporal connection of the slider 4 with the base 2. At the same time, the lifter handle 8 is rotated to move the hand grip 10 to its uppermost position. Under such a condition, the lifter 1 is moved to a position near the lane maintenance machine 40. The upper grip arm 10*b* is then raised to place the hand grip 10 in the open position. The upper grip arm 10*b* is then moved down to grasp the handle 41 of the lane maintenance machine 40 between the upper and lower grip arms (see FIG. 22).

Second, the operator grasps the grips 11*a*, 11*b*, 11*c* and/or 11*d* and pushes the lane maintenance machine 40 with his or her one leg while keeping the balance. At the same time, the operator rotates the lifter handle 8 to move the hand grip 10 in the downward direction (see FIG. 21). The hand grip 10 will be lowered to a position wherein the pulling-out wheels 43 of the lane maintenance machine can be used, that is, the pulling-out wheels 43 are spaced away from the floor by a distance between 10 cm and 15 cm (see FIG. 20).

Third, the temporal catch 13 is disengaged from the hooked projection 14. The operator then grasps grips 11*a*, 11*b*, 11*c* and/or 11*d* and push the lifter 1 away from him or her such that the support and slider 3, 4 will be moved to their forwardmost position (see FIG. 19).

Fourth, the operator again rotates the lifter handle 8 to move the hand grip 10 downwardly to a position wherein the ground wheels of the lane maintenance machine 40 completely seat on the floor while using the pulling-out wheels 43 (see FIG. 18). In such a position, the upper grip arm 10*b* is raised to disengage the hand grip 10 from the handle 41 of the lane maintenance machine 40. Thus, the lane maintenance machine 40 can be separated from the lifter 1.

The locus of the lifter handle 8 through the first to fourth steps is in the opposite direction as shown by arrow in FIG. 23.

Figure 24:
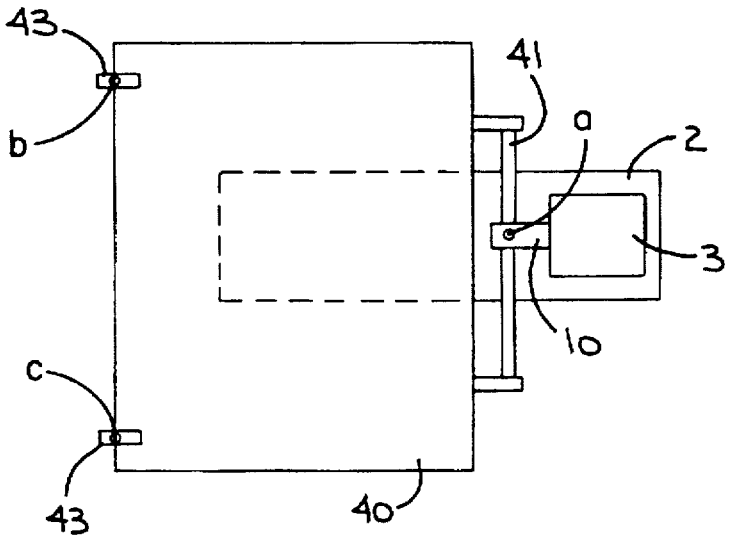
FIG. 24 is a view showing the positional relationship between the lifter of the present invention and the lane maintenance machine.

According to the aforementioned procedure, the lifter can be prevented from being fallen down when the lane maintenance machine is being shifted from one position to the other position. More particularly, when the load is to be applied to the front of the lifter, the support is positioned behind the lifter. Further, the hand grip and two pulling-out wheels of the lane maintenance machine are located at three points a, b and c, as shown in FIG. 24. Therefore, the lane maintenance machine can be shifted from one position to the other position while being stabilized.

As described, the lifter of the present invention can be used to shift the lane maintenance machine from its running position to its moved and transported position or vice versa with a reduced force in an easy manner. Since the lifter is of a strong structure, such a shifting process can be safely carried out. Since the lifter is also of a simplified structure, it can be produced more simply and cheaply.

I claim:

1. A lifter suitable for use in shifting a bowling lane maintenance machine having a handle from a position wherein the lane maintenance machine can be run upon the surface of a bowling lane to another position apart from the bowling lane where the machine can be stored, or vice versa, the lifter comprising:

means for grasping the handle of the bowling lane maintenance machine;

an elongate hollow vertical support having front, back, and side walls;

a first carriage;

means for mounting the first carriage for vertical movement along the vertical support;

means for connecting the grasping means to the first carriage;

means for driving the first carriage vertically along the vertical support;

an elongate base comprising front, back, and side members;

means for movably supporting the base upon an underlying surface;

a second carriage;

means for mounting the second carriage for horizontal movement along the base; and wherein the vertical support is fixedly attached to the second carriage.

2. The lifter as defined in claim 1 wherein the grasping means comprises a lower arm, an upper arm, and means for pivotally connecting the upper and lower arms so that the grasping means may be opened and closed;

means for limiting the horizontal movement of the second carriage upon the base; and means for stopping movement of the base upon the underlying surface.

3. The lifter as defined in claim 1 wherein the vertical support comprises a hollow column-like member of folded steel sheet having inner and outer side walls, and the vertical driving means comprises;

an upper sprocket supported by an upper sprocket shaft, the upper sprocket shaft being rotatably attached at its opposite ends to opposing side walls of the vertical support and adjacent a top of the vertical support;

a first worm wheel gear fixed upon the upper sprocket shaft;

a second worm gear in operative engagement with the first worm wheel gear;

handle means for rotating the second worm gear;

means for rotatably mounting the handle and second worm gear upon the vertical support;

a lower sprocket supported by a lower sprocket shaft, the lower sprocket shaft being rotatably attached at its opposite ends to opposing side walls of the vertical support and adjacent a bottom of the vertical support;

a drive chain looped around the upper and lower sprockets; and means for connecting the drive chain to the first carriage.

4. The lifter of claim 3 wherein the vertical support comprises a pair of guide pillars attached to an inside of opposite side walls of the vertical support;

the guide pillars, the inside walls to which they are attached, and the front wall of the support together comprising guide channels;

the first carriage comprising a plurality of guide wheels configured to ride within the guide channels;

the second carriage comprising a rectangular frame having side walls, front and back supporting wheels, and means for rotatingly attaching the said wheels to the side walls of the frame; and wherein the side members of the base comprise C-shaped channels, and the supporting the wheels of the second carriage ride within the C-shaped channels.

5. The lifter of claim 1 wherein the base further comprises:

a pair of front wheels supported by a front axle;

a pair of back wheels supported by a back axle;

said front and back axles each extending respectively through elliptical holes in opposite side members of the base, the elliptical holes being oriented with a long axis vertical and a diameter of the axles being sized so that the axles are free to move up and down within a elliptical holes;

spring means mounted between the axles and the base for urging the front and back axles downwardly of the base;

a plurality of protective members of preselected thickness attached to the bottom of the base;

the elliptical holes and axles being sized such that the front and back axles may move upwardly against the action of the spring means sufficiently to permit the protective members to contact the floor beneath the lifter;

whereby pressure on the front and back axles and wheels of the base is relieved when sufficient weight is placed upon the lifter.

6. A method of using the lifter defined in claim 1 to move a bowling lane maintenance machine from the operating position on a bowling lane to a second stored position comprising the steps of:

moving the first carriage and vertical support forward on the base, causing the grasping means to grasp the handle of a bowling lane maintenance machine positioned in the running position on the bowling lane;

raising the gasping means and handle of the bowling lane maintenance machine sufficiently to permit the base of the lifter to move between the bottom of the bowling lane maintenance machine and the floor;

moving the first carriage to a middle position on the lifter base;

actuating the vertical driving means to lift the grasping means and grasped handle of the bowling lane maintenance machine upwardly to a point where the base of the lifter may be inserted between the machine and the floor;

moving the first carriage and vertical support to the rear of the base;

actuating the vertical driving means to lift the grasping means further upwardly until the bowling lane maintenance machine is standing upright on its casters; and releasing the grasping means from the handle of the bowling lane maintenance machine and moving said lifter away from the bowling lane maintenance machine, whereby said bowling lane maintenance machine can be moved from the operating position on the bowling lane to an upright stored position.

7. A method of using the lifter of claim 1 for moving a bowling lane maintenance machine from an upright stored position to the operating position lying down on a bowling lane, comprising the steps of:

moving the grasping means to the most upward position on the vertical support;

moving the first carriage and vertical support to the most rearward position;

grasping the handle of the upright bowling lane maintenance machine with the gasping means;

moving the lifter and the bowling lane maintenance machine to position the bowling lane maintenance machine in its operating position over the bowling lane;

actuating said vertical driving means to lower said grasping means to a middle position on the vertical support so as to lower the bowling lane maintenance machine onto its wheels;

moving the first carriage and grasping means to the most forward position on the lifter;

actuating the vertical driving means to lower the grasping means until the bowling lane maintenance machine reaches its operating position on the bowling lane;

releasing the grasping means from the handle of the bowling lane maintenance machine; and moving the lifter away from the bowling lane maintenance machine, whereby the bowling lane maintenance machine can be shifted from a stored position to the operating position.

* * * * *